US011168423B2

(12) United States Patent
Aurich

(10) Patent No.: US 11,168,423 B2
(45) Date of Patent: Nov. 9, 2021

(54) DYE FIXING SECTION FOR AN INDIGO DYEING MACHINE

(71) Applicant: Gaston System, Inc., Stanley, NC (US)

(72) Inventor: Christoph W. Aurich, Clemson, SC (US)

(73) Assignee: Gaston Systems, Inc., Stanley, NC (US)

( * ) Notice: Subject to any disclaimer, the term of this patent is extended or adjusted under 35 U.S.C. 154(b) by 0 days.

(21) Appl. No.: 16/298,766

(22) Filed: Mar. 11, 2019

(65) Prior Publication Data

US 2020/0224347 A1 Jul. 16, 2020

Related U.S. Application Data

(60) Provisional application No. 62/641,764, filed on Mar. 12, 2018.

(51) Int. Cl.

| | |
|---|---|
| ***D06B 19/00*** | (2006.01) |
| ***D06P 1/22*** | (2006.01) |
| ***D06B 23/18*** | (2006.01) |
| ***D06B 23/02*** | (2006.01) |

(52) U.S. Cl.

CPC ..... *D06B 19/0005* (2013.01); *D06B 23/02* (2013.01); *D06B 23/18* (2013.01); *D06P 1/228* (2013.01)

(58) Field of Classification Search

None

See application file for complete search history.

(56) References Cited

U.S. PATENT DOCUMENTS

| | | | | |
|---|---|---|---|---|
| 3,067,758 | A | 12/1962 | Hersh | |
| 3,969,780 | A | 7/1976 | Henderson | |
| 4,023,526 | A | 5/1977 | Atshmus et al. | |
| 4,061,001 | A | 12/1977 | von der Eltz et al. | |
| 4,099,913 | A | 7/1978 | Walter et al. | |
| 4,118,183 | A * | 10/1978 | Godau | D02H 5/02 8/495 |
| 4,193,762 | A | 3/1980 | Namboodri | |
| 4,237,818 | A | 12/1980 | Clifford et al. | |
| 4,283,198 | A | 8/1981 | Fletcher | |
| 4,305,169 | A | 12/1981 | Vidalis | |
| 4,365,968 | A | 12/1982 | Gregorian et al. | |
| 4,402,200 | A | 9/1983 | Clifford et al. | |
| 4,435,965 | A | 3/1984 | Sasseville et al. | |
| 4,532,782 | A | 8/1985 | Sellers | |

(Continued)

FOREIGN PATENT DOCUMENTS

| | | | |
|---|---|---|---|
| DE | 3034803 | A1 | 3/1982 |
| EP | 0525434 | A1 | 2/1993 |

(Continued)

*Primary Examiner* — Michael E Barr
*Assistant Examiner* — Pallavi Chitta
(74) *Attorney, Agent, or Firm* — Tillman Wright, PLLC; James D. Wright; David R. Higgins

(57) ABSTRACT

A dye fixing section in a foam indigo dyeing machine for dyeing traveling sheets of textile yarn. The dye fixing section receives traveling sheets of yarn to which indigo dye in leuco form has been applied and penetrated partially through the yarn. Oxygen is applied to the substrate to set the dye at the level of penetration achieved as it enters the dye fixing section, to produce yarns in the sheet with outer dyed rings and undyed cores.

8 Claims, 4 Drawing Sheets

(56) References Cited

U.S. PATENT DOCUMENTS

| | | | | |
|---|---|---|---|---|
| 4,562,097 | A | 12/1985 | Walter et al. | |
| 4,613,335 | A | 9/1986 | Berendt et al. | |
| 4,655,056 | A | 4/1987 | Zeiffer | |
| 4,884,893 | A | 12/1989 | Zeiffer et al. | |
| 5,063,646 | A | 11/1991 | Zeiffer et al. | |
| 5,168,731 | A | 12/1992 | Vidalis | |
| 5,195,225 | A | 3/1993 | Zeiffer et al. | |
| 5,201,959 | A | 4/1993 | Fuller | |
| 5,219,620 | A | 6/1993 | Potter et al. | |
| 5,323,629 | A | 6/1994 | Aurich et al. | |
| 5,337,586 | A * | 8/1994 | Ronchi | D06B 3/04 15/316.1 |
| 5,494,491 | A | 2/1996 | Gurley | |
| 6,355,073 | B1 | 3/2002 | Godau | |
| 6,395,088 | B1 | 5/2002 | Zeiffer | |
| 6,432,202 | B1 | 8/2002 | Aurich | |
| 6,852,196 | B2 | 2/2005 | Capizzi | |
| 6,858,256 | B2 | 2/2005 | Zeiffer | |
| 7,913,524 | B2 | 3/2011 | Aurich et al. | |
| 10,704,174 | B2 | 7/2020 | Aurich et al. | |
| 2005/0241078 | A1 | 11/2005 | Aurich et al. | |
| 2007/0266505 | A1 | 11/2007 | Aurich et al. | |
| 2009/0282621 | A1* | 11/2009 | Kennedy | F16J 15/168 8/149.2 |
| 2019/0136430 | A1 | 5/2019 | Aurich et al. | |
| 2020/0165774 | A1* | 5/2020 | Malpass | D06B 23/18 |

FOREIGN PATENT DOCUMENTS

| | | | |
|---|---|---|---|
| EP | 0799924 | A2 | 10/1997 |
| EP | 0995826 | A2 | 4/2000 |
| EP | 1065308 | A2 | 1/2001 |
| EP | 1657338 | A2 | 5/2006 |
| WO | 2006013458 | A1 | 2/2006 |

* cited by examiner

DYE FIXING SECTION FOR AN INDIGO DYEING MACHINE

The present non-provisional patent application claims the benefit of the filing date of Mar. 12, 2018 of Provisional U.S. Patent Application Ser. No. 62/641,764.

BACKGROUND OF THE INVENTION

Dyeing textile substrates, such as yarn, with indigo dye is well known. This includes the applying of indigo dye in a leuco state to a traveling textile substrate in an inert atmosphere in which the dye is allowed to fully penetrate the substrate, and then exposing the dyed substrate to the ambient atmosphere in which the oxygen in the ambient atmosphere (approximately 20%) reacts with the dye to oxidize and thereby fix the dye in the substrate.

Indigo dyed yarn is commonly used to weave fabric for the manufacture of blue jeans, overalls, and other items of clothing. It has become fashionable for blue jeans to be manufactured with areas having the appearance of the dye having been worn off leaving white or undyed areas. To provide this appearance, fabric is commonly completely dyed throughout and then purposely subjected to wearing down the fabric in selected areas to remove the dye, which often results in the fabric being worn through, leaving open areas.

BRIEF DESCRIPTION OF THE PRESENT INVENTION

The present invention is directed to rapidly fixing or setting foamed leuco state indigo dye in a traveling sheet of textile substrate, such as a sheet of yarns, before the dye fully penetrates the substrate. The leuco state indigo dye is applied to the substrate in an inert atmosphere and travels through a dwell chamber in an inert atmosphere to allow the dye to begin penetrating into the substrate. Before the dye completely penetrates the substrate, the substrate leaves the dwell chamber and is subjected to commercially pure oxygen that quickly fixes or sets the indigo dye at the level of penetration obtained as it left the dwell chamber, resulting in the substrate having a dyed outer ring and an undyed core.

DETAILED DESCRIPTION OF THE PREFERRED EMBODIMENTS OF THE PRESENT INVENTION

Figure 1:
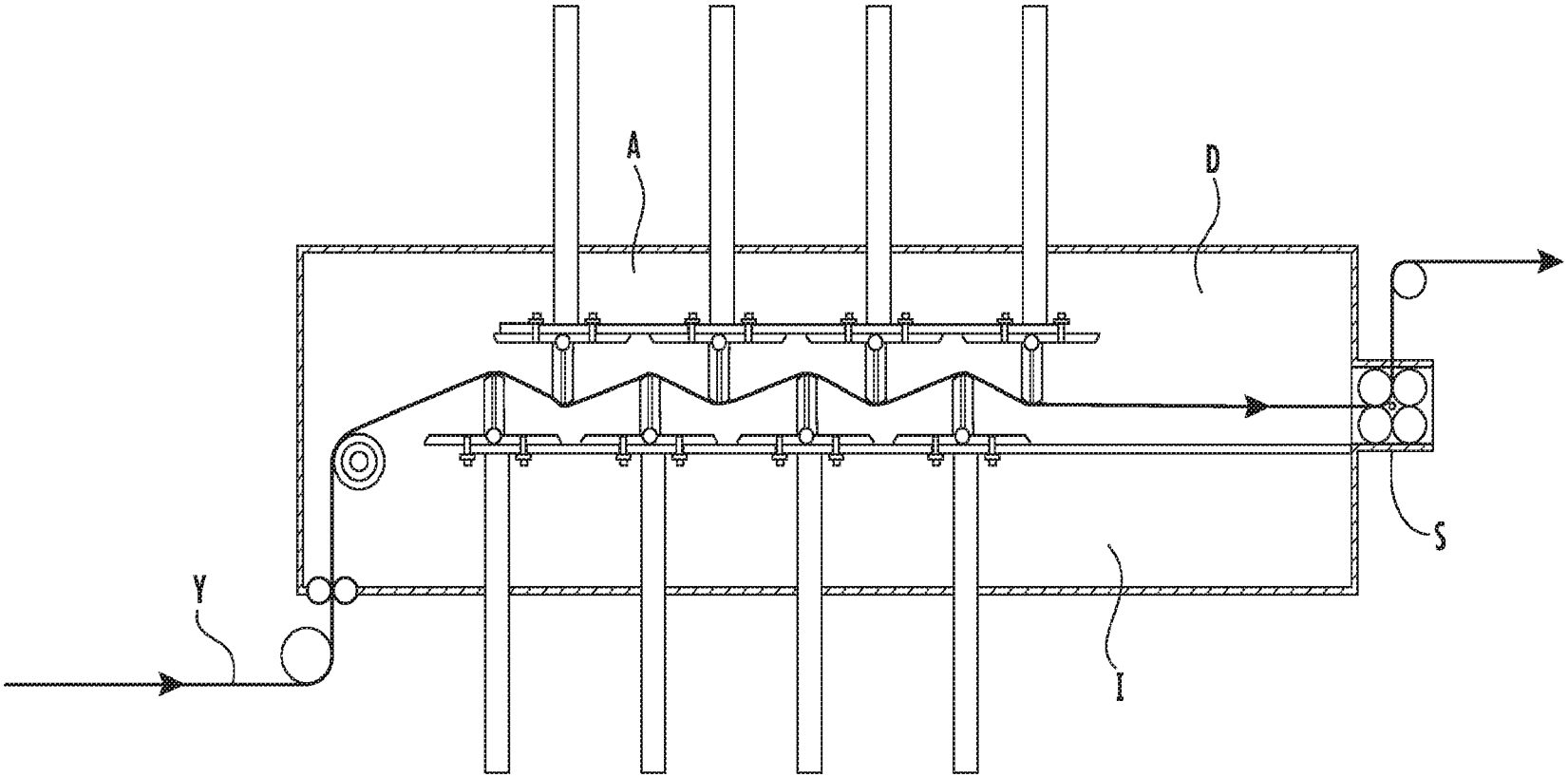
FIG. 1 is an elevation view of a dyeing machine in which the dye fixing section of the preferred embodiment of the present invention is incorporated.

The preferred embodiment of the dye fixing section S of the present invention is illustrated in FIGS. 1, 2, 3, and 4. It is combined with a foam dyeing application chamber A of the type disclosed in U.S. Pat. No. 7,913,524, in which indigo dye in a leuco state is applied in foam form to a sheet of traveling yarns Y in an inert atmosphere I, such as nitrogen. The applied foam disintegrates on the sheet of yarns Y leaving liquid leuco state indigo dye on the surface of the yarns Y. The sheet of yarns Y then travels through a dwell chamber D, also containing the inert nitrogen atmosphere I, to allow the dye to penetrate into the yarn, which is facilitated by the moisture resulting from the disintegration of the foam. The dye penetration progresses into the yarns in the dwell chamber for a selected limited distance to obtain limited dye penetration to a selected extent. The yarn sheet then enters the housing 10 of the dye fixing section S through the nip 12 of the entry of a first pair of driven nip rollers 14, 16 in the open end 18 of the housing 10 of the dye fixing station S. The first pair of nip rollers 14, 16 is driven by a motor unit 20 in a direction to cause the sheet of yarns Y to travel from the exit of the nip 12 into the dye fixing section S.

A second pair of driven nip rollers 22, 14 is mounted in the housing 10 parallel to and in nip forming engagement with the first pair of nip rollers 14, 16, thereby defining a confined limited space 26 therebetween. The upper rollers 14, 22 of the pairs of driven rollers rotate in opposite directions to form a nip 30 having an entry in the confined space 26 for the sheet of yarns Y and an exit exteriorly of the space 26 for travel of the sheet of yarns Y in the confined space 26 around the upper roller 14 of the first pair 14, 16 and through the nip 28 formed by the two upper rollers 14, 22 to the ambient atmosphere to expose the sheet of yarns Y for drying the moisture resulting from the dissipation of the applied foam.

The confined space 26 contains commercially pure oxygen 30 (FIG. 5) delivered from a container 32 of compressed oxygen through a pipe 34 connecting the container 32 with an entry port 36 in the housing 10 opening into the confined space 26. An adjustable valve 38 is connected in the pipe 34 to adjustably control the feed of oxygen into the confined space 26, and an exit port 40 connects the interior of the confined space 26 to permit exit of oxygen from the confined space to the exterior.

Figure 5:
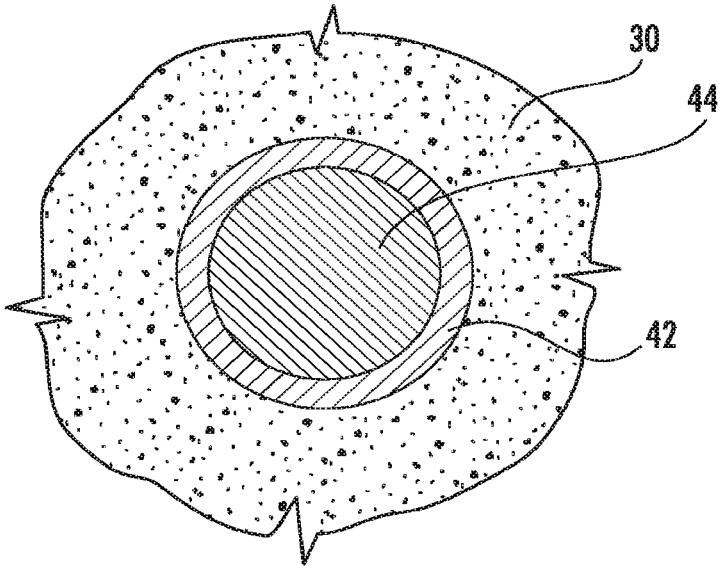
FIG. 5 is an enlarged cross-sectional view of a yarn dyed in the dye fixing section of FIG. 2.

The extent of travel of the sheet of yarns Y through the dwell chamber D is selected in relation to the speed of travel of the traveling sheet of yarns Y, which conventionally may be about 50 meters per minute, to allow the dye to only partially penetrate the interior of the individual yarns to a desired extent as it enters the confined space 26 in which the yarns of the traveling sheet of yarn Y are subjected to oxygen that fixes the indigo dye into a solid state affixed to the yarns Y at the level of desired penetration obtained in the dwell chamber, as illustrated in FIG. 5. This fixed limited penetration results in the yarns having an indigo dyed outer ring 42 of purple indigo dye and an undyed white core 44. When the yarns Y are subsequently made into a fabric, areas of the dyed outer ring 42 can be removed by conventional stone washing, bleach, chemical treatment, or other suitable treatment to expose the undyed inner core 44, providing a fashionably desirable localized worn appearance without significantly destroying the integrity of the core 44.

The upper roller 14 of the first pair of rollers 14, 16 and the lower roller 24 of the second pair of rollers 22, 24 have outer circumferential layers 46 of rubber (FIG. 4) that facilitate traction for driving the sheet of yarns Y through and from the dye setting section S, and are compressible to provide sealing engagement of the sheet of yarns Y with the surfaces of the other rollers 16, 22 of the pairs of rollers to prevent passage of the inert nitrogen in the dwell chamber through the nip 12 and into the housing 10 and escape of oxygen from the confined space 26 between rollers.

Figure 4:
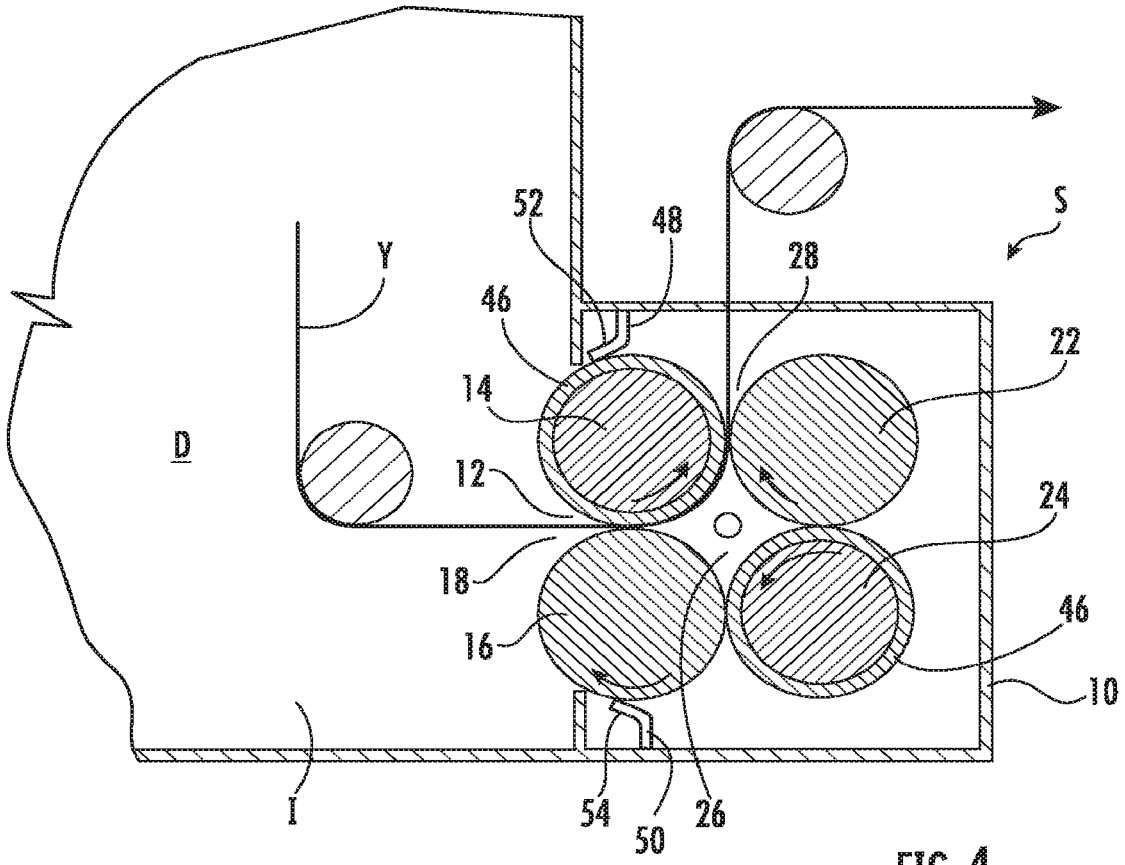
FIG. 4 is a side elevational view of the dye fixing section of FIG. 2.
Figure 7:
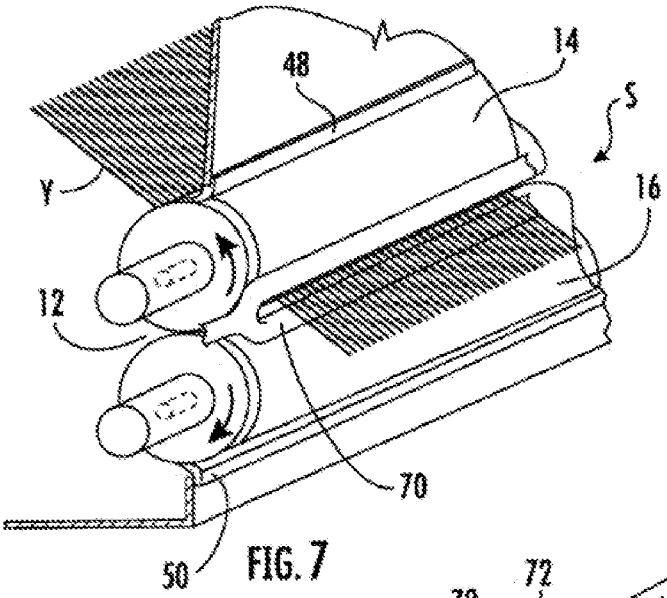
FIG. 7 is an enlarged perspective view of a further embodiment of the dye fixing section of the present invention.

Sealing elements, illustrated in FIGS. 4 and 7, seal escape of inert nitrogen from the dwell chamber D into the dye fixing section between the exterior of the first pair of rollers 14, 16 and the housing 10. These sealing elements include a pair of sealing elements in the form of resilient panels or flaps 48, 50 secured to the interior of the housing 10 above and below the first pair of rollers 14, 16 and extending along the width of the housing 10. These sealing flaps 48, 50 have flexible end portions 52, 54 in contact with and extending along each roller 14, 16 of the first pair of rollers in the direction of rotation of the respective rollers.

Figure 2:
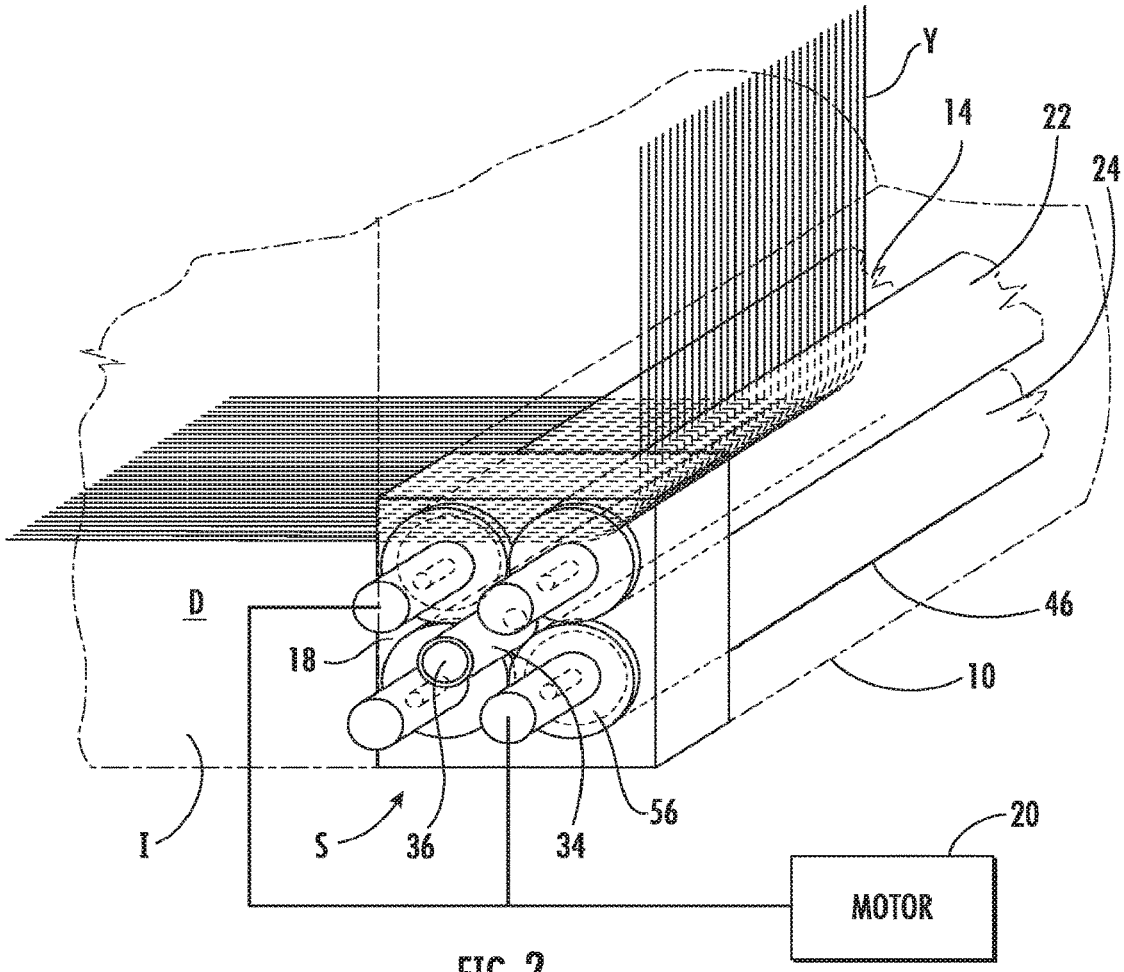
FIG. 2 is an enlarged perspective view of the dye fixing section of the preferred embodiment of the present invention illustrated in FIG. 1.
Figure 3:
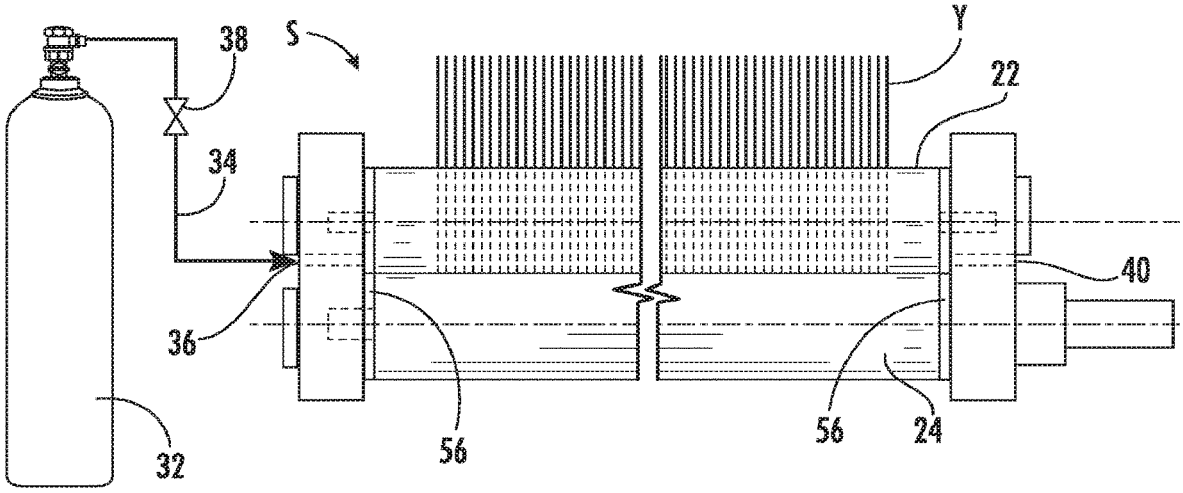
FIG. 3 is a front elevational view of the dye fixing section of FIG. 2.

As seen in FIGS. 2, 3, and 7, the spaces between the ends of the rollers 14, 16, 22, 24 and the housing 10 are sealed by discs 56 of compressible material, such as felt, mounted on the ends of the rollers, and in sealing contact with the sealing flaps 48, 50 and with the adjacent walls of the housing 10.

Figure 6:
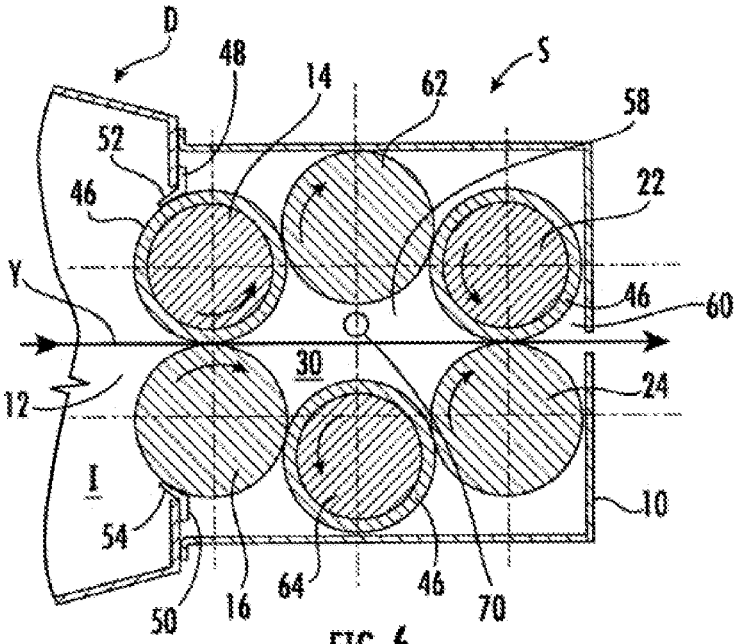
FIG. 6 is a cross-sectional view of another embodiment of the dye fixing section of the present invention.

A second preferred embodiment of the present invention is illustrated in FIG. 6. This second embodiment has the same components and arrangement as the first embodiment described above, and in addition provides for passage of the traveling sheet of yarns Y through the confined dye fixing space 58 free of contact with any of the rollers, so that both sides of the sheet of yarns Y are equally exposed to the dye setting oxygen. In this embodiment the sheet of yarns Y travels straight through the dye fixing space 58 from the nip 12 between the first pair of rollers 14, 16 to the nip 60 between the second pair of rollers 22, 24. This is accomplished by a pair of spaced intermediate rollers 62, 64 mounted in the housing 10 between and in nip forming engagement with the first and second pairs of rollers 14, 16, 22, 24, with the rollers of the intermediate pair of rollers 62, 64 being spaced apart, rather than forming a nip. The rollers 62, 64 of the intermediate pair of rollers are spaced apart by being of a larger diameter than the space between the first and second pairs of nip rollers 14, 16, 22, 24 so that the oxygen containing space 58 extends unobstructed from the nip 12 of the first pair of rollers 14, 16, between the spaced apart intermediate pair of rollers 62, 64 to the nip 66 of the second pair of rollers. This results in the rollers of the first and second pairs of nip rollers 14, 16, 22, 24 rotating in the same direction for driving the traveling sheet of yarns Y into the dye fixing section S by the first pair 14, 16, straight through the space 58, and out of the dye fixing section S by the second pair 22, 24.

Figure 8:
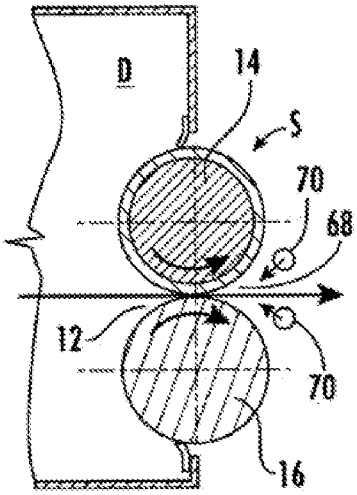
FIG. 8 is a cross-sectional view the further embodiment of the dye fixing section of the present invention of FIG. 7.
Figure 9:
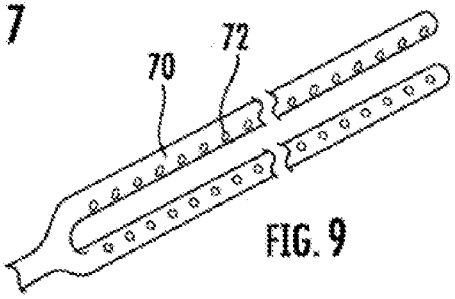
FIG. 9 is an enlarged perspective view of the pair of spaced oxygen dispensing tubes of FIG. 7.

A third preferred embodiment of the dye fixing section S of the present invention is illustrated in FIGS. 7 and 8. In this embodiment the dye fixing section S includes the first pair of nip rollers 14, 16 of the other embodiments between which the sheet of yarns Y with leuco state indigo dye thereon travels from the dwell chamber D into an open space 68 in which oxygen is applied to the traveling sheet of yarns immediately upon entering the open space 68 after leaving the nip 12 of the pair of rollers 14,16. The oxygen is applied under pressure from a source, such as the same type of container of pressurized oxygen referred to above, through a pair of spaced oxygen dispensing tubes 70 extending along the extent of the pair of rollers 14, 16 and between which the sheet of yarns Y with leuco state indigo dye thereon travel. The dispensing tubes 70 have a plurality of apertures 72 spaced along their lengths and facing the sheet of yarns S' through which oxygen is sprayed on opposite sides of the traveling sheet of yarns Y to fix the indigo dye at the level of penetration achieved in the dwell chamber D, providing the yarns of said traveling sheet with a ring of dyed indigo and an undyed white core (FIG. 5).

Having the dye fixed in a small space by an arrangement of nip rollers or by spraying directly on the substrate has the significant advantage of limiting the amount of expensive pure oxygen necessary to obtain satisfactory results.

The method performed with each of the foregoing preferred embodiments involves applying oxygen to a traveling sheet of textile substrate, such as a sheet of yarn, to which indigo dye in a leuco state has been applied and allowed to partially penetrate in an inert atmosphere. The oxygen is applied to fix the indigo dye on the substrate at the partially penetrated extent, leaving an undyed core.

While the preferred embodiments are specific to dyeing sheets of textile yarn, it should be understood that the present invention is applicable as well to other forms of sheets of textile material, such as woven or knitted textile fabrics.

In view of the aforesaid written description of the present invention, it will be readily understood by those skilled in the art that the present invention is susceptible of broad utility and application. Many embodiments and adaptations of the present invention other than those herein described, as well as many variations, applications, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative of examples of the present invention, and is made merely for purposes of providing a full and enabling disclosure of the invention. The foregoing disclosure is not intended nor is it to be construed to limit the present invention or otherwise to exclude any other embodiment, adaptations, variations, modifications, and the equivalent arrangements, the present invention being limited only by the claims appended hereto and the equivalents thereof.

What is claimed is:

1. An indigo dyeing machine that applies indigo dye in a leuco state in foam form to a travelling sheet of textile substrate in an inert atmosphere in a dye applicating chamber sealed from the ambient atmosphere, followed by a dwell chamber communicating with the applicating chamber in which the dye partially penetrates the travelling substrate in an inert atmosphere, and the dwell chamber has an exit opening through which said traveling sheet of textile substrate exits the dwell chamber, said dye fixing section comprising:

a pair of driven nip rollers extending across said exit opening of the dwell chamber and having a nip with an entry for receiving said travelling sheet of textile substrate from said dwell chamber, and an exit from which said travelling substrate exits;

sealing elements engaging said pair of nip rollers in a housing in contact with said nip rollers to prevent escape of said inert atmosphere from said dwell chamber;

a source of oxygen for supplying oxygen to said travelling sheet of textile substrate exiting said nip rollers to set the dye at the level of penetration achieved in said dwell chamber; and wherein said housing extends from said dwell chamber exit opening, and said pair of nip rollers is mounted in said housing at said dwell chamber exit opening; and wherein said pair of driven nip rollers is a first pair of driven nip rollers and characterized further by a second pair of driven nip rollers in said housing in nip contact with said first pair of nip rollers to define a confined space therebetween at the exit of said nip of said first driven nip rollers for containing said oxygen for contact with said traveling sheet of textile substrate to fix the dye at the level of penetration achieved in said dwell chamber, and the nip contact of one of said second nip rollers with one of said first nip rollers having an exit from which said traveling sheet of textile substrate exits said housing.

2. The indigo dyeing machine of claim 1 characterized further in that said sealing elements are resilient panels secured to said housing and having end portions extending along said traveling sheet of textile substrate in sealing relation.

3. The indigo dyeing machine of claim 2 characterized further in that said sealing elements include discs of compressible material mounted on the ends of said rollers in sealing contact with said end portions of said resilient panels and with said housing.

4. The indigo dyeing machine of claim 1 characterized further in that one of said pair of nip rollers includes an outer layer of resilient material to facilitate sealing of said nip from escape therethrough of inert gas from said dwell chamber and to facilitate driving engagement with said traveling sheet of textile substrate.

5. The indigo dyeing machine of claim 1 wherein said traveling sheet of textile substrate is a traveling sheet of textile yarns.

6. The indigo dyeing machine of claim 1 and characterized further in that said source of oxygen includes an oxygen dispenser extending along and in close proximity to said exit of said nip of said pair of nip rollers.

7. The indigo dyeing machine of claim 6 wherein said oxygen dispenser is a tube having apertures through which oxygen is sprayed onto said traveling sheet of textile substrate.

8. The indigo dyeing machine of claim 7 characterized further in that there are two said dispensers extending along opposite sides of said traveling sheet of textile substrate.

* * * * *